US006541902B1

(12) United States Patent
Carpinelli et al.

(10) Patent No.: US 6,541,902 B1
(45) Date of Patent: Apr. 1, 2003

(54) SPACE-SAVING CATHODE RAY TUBE

(75) Inventors: Joseph Michael Carpinelli, Lawrenceville, NJ (US); Dennis John Bechis, Yardley, PA (US); Jeffrey Paul Johnson, Lawrenceville, NJ (US); David Arthur New, Mercerville, NJ (US); George Herbert Needham Riddle, Princeton, NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/559,809

(22) Filed: Apr. 26, 2000

Related U.S. Application Data

(60) Provisional application No. 60/131,919, filed on Apr. 30, 1999, and provisional application No. 60/160,654, filed on Oct. 21, 1999.

(51) Int. Cl.[7] ..... H01J 29/72

(52) U.S. Cl. ..... 313/421; 313/439; 313/432

(58) Field of Search ..... 313/421, 422, 313/426, 427, 431, 409, 433, 439, 432; 315/169.1, 169.3

(56) References Cited

U.S. PATENT DOCUMENTS

| | | | | |
|---|---|---|---|---|
| 3,005,921 A | * | 10/1961 | Godfrey | 313/421 |
| 3,185,879 A | | 5/1965 | Evans, Jr. | |
| 3,683,224 A | * | 8/1972 | Lea | 313/422 |
| 4,323,816 A | | 4/1982 | Chang | |
| 4,329,618 A | | 5/1982 | Chang | |
| 4,374,343 A | | 2/1983 | Chang | |
| 5,036,258 A | | 7/1991 | Chen et al. | |
| 5,204,585 A | | 4/1993 | Chen | |
| 5,327,044 A | | 7/1994 | Chen | |
| 5,357,176 A | * | 10/1994 | Nishio et al. | 313/439 |

FOREIGN PATENT DOCUMENTS

| | | |
|---|---|---|
| DE | 14 87 095 | 1/1969 |
| EP | 0 221 639 A | 5/1987 |
| EP | 0 334 438 | 9/1989 |
| EP | 0 418 962 | 3/1991 |
| GB | 865667 | 4/1961 |
| GB | 903587 | 8/1962 |
| GB | 2059144 | 4/1981 |
| GB | 2 114 806 A | 8/1983 |
| JP | 60200444 | 10/1985 |

* cited by examiner

*Primary Examiner*—Vip Patel
*Assistant Examiner*—Joseph Williams
(74) *Attorney, Agent, or Firm*—William J. Burke

(57) ABSTRACT

A cathode ray tube includes an electron gun directing electrons towards a faceplate having an electrode biased at screen potential. The electron beam is magnetically deflected to scan across the faceplate to impinge upon phosphors thereon to produce light depicting an image or information. A neck electrode near the tube neck is biased at or below screen potential and a second electrode between the neck electrode and the faceplate is biased at or above screen potential. As a result, the electrons are deflected over a greater total angle than is obtained from the magnetic deflection. A third electrode proximate the faceplate is biased at or below screen potential to direct electrons towards the faceplate, thereby to increase the landing angle of the electrons thereon.

30 Claims, 6 Drawing Sheets

SPACE-SAVING CATHODE RAY TUBE

This Application claims the benefit of U.S. Provisional Application Serial No. 60/131,919 filed Apr. 30, 1999, and of U.S. Provisional Application Serial No. 60/160,654 filed Oct. 21, 1999.

The present invention relates to a cathode ray tube and, in particular, to a cathode ray tube including one or more deflection aiding electrostatic fields.

Conventional cathode ray tubes (CRTs) are widely utilized, for example, in television and computer displays. One or more electron guns positioned in a neck of a funnel-shaped glass bulb of a CRT direct a corresponding number of beams of electrons toward a glass faceplate biased at a high positive potential, e.g., 30 kilovolts (kV). The faceplate usually has a substantially rectangular shape and is generally planar or slightly curved. Together, the glass bulb and faceplate form a sealed enclosure that is evacuated. The electron gun(s) are positioned along an axis that extends through the center of the faceplate and is perpendicular thereto.

The electron beam(s) is (are) raster scanned across the faceplate so as to impinge upon a coating or pattern of phosphors on the faceplate that produces light responsive to the intensity of the electron bean, thereby to produce an image thereon. The raster scan is obtained by a deflection yoke including a plurality of electrical coils positioned on the exterior of the funnel-shaped CRT near the neck thereof. Electrical currents driven in first coils of the deflection yoke produce magnetic fields that cause the electron beam(s) to deflect or scan from side to side (i.e. horizontal scan) and currents driven in second coils of the deflection yoke produce magnetic fields that cause the electron beam(s) to scan from top to bottom (i.e. vertical scan). The magnetic deflection forces typically act on the electrons of the beam(s) only in the first few centimeters of their travel immediately after exiting the electron gun(s), and the electrons travel in a straight line trajectory thereafter, i.e through a substantially field-free drift region. Conventionally, the horizontal scan produces hundreds of horizontal lines in the time of each vertical scan to produce the raster-scanned image.

The depth of a CRT, i.e. the distance between the faceplate and the rear of the neck, is determined by the maximum angle over which the deflection yoke can bend or deflect the electron beam(s) and the length of the neck extending rearward to contain the electron gun. Greater deflection angles provide reduced CRT depth.

Modem magnetically-deflected CRTs typically obtain a ±55° deflection angle, which is referred to as 110° deflection. However, such 110° CRTs for screen diagonal sizes of about 62 cm (about 25 inches) or more are so deep that they are almost always provided in a cabinet that either requires a special stand or must be placed on a floor. For example, a 110° CRT having a faceplate with an about 100 cm (about 40 inch) diagonal measurement and a 16:9 aspect ratio, is about 60–65 cm (about 24–26 inches) deep. Practical considerations of increasing power dissipation producing greater temperature rise in the magnetic deflection yoke and its drive circuits and of the higher cost of a larger, heavier, higher-power yoke and drive circuitry make increasing the maximum deflection angle so as to decrease the depth of the CRT is disadvantageous.

A further problem in increasing the deflection angle of conventional CRTs is that the landing angle of the electron beam on the shadow mask decreases as deflection angle is increased. Because the shadow mask is as thin as is technically reasonable at an affordable cost, the thickness of the present shadow mask results in an unacceptably high proportion of the electrons in the electron beam hitting the side walls of the apertures in the shadow mask for low landing angles. This produces an unacceptable reduction of beam current impinging on the phosphor and a like decrease in picture brightness for low landing angles, e.g., landing angles less than about 25°.

One approach to this depth dilemma has been to seek a thin or so-called "flat-panel" display that avoids the large depth required by conventional CRTs. Flat panel displays, while desirable in that they would be thin enough to be hung on a wall, require very different technologies from conventional CRTs which are manufactured in very high volume at reasonable cost. Thus, flat panel displays are not available that offer the benefits of a CRT at a comparable cost. But a reduced-depth cathode ray tube as compared to a conventional CRT need not be so thin that it could be hung on a wall to overcome the disadvantage of the great depth of a conventional CRT.

Accordingly, there is a need for a cathode ray tube having a depth that is less than that of a conventional CRT having an equivalent screen-size.

To this end, the tube of the present invention comprises a tube envelope having a faceplate and a screen electrode on the faceplate adapted to be biased at a screen potential, a source of a beam of electrons directed toward the faceplate, wherein the source is adapted for magnetic deflection of the beam of electrons, and phosphorescent material disposed on the faceplate for producing light in response to the beam of electrons impinging thereon. At least first and second electrodes are interior the tube envelope, each having a respective aperture through which the beam of electrons passes, wherein the first electrode is intermediate the source and the faceplate and is adapted to be biased at a potential not less than the screen potential, and wherein the second electrode is between the first electrode and the faceplate and is adapted to be biased at a potential less than the screen potential.

According to another aspect of the invention, a display comprises a tube envelope having a faceplate and a screen electrode on the faceplate biased at a screen potential, a source within the tube envelope of a beam of electrons directed toward the faceplate, a deflection yoke proximate the source of a beam of electrons for magnetically deflecting the beam of electrons, and a phosphorescent material disposed on the faceplate for producing light in response to the beam of electrons impinging thereon. At least first and second electrodes are within the tube envelope, each having a respective aperture through which the deflected beam of electrons passes, wherein the first electrode is intermediate the source of a beam of electrons and the faceplate and is biased at a first potential not less than the screen potential, and wherein the second electrode is between the first electrode and the faceplate and is biased at a second potential less than the screen potential. A source of potential provides the first, second and screen potentials.

BRIEF DESCRIPTION OF THE DRAWING

The detailed description of the preferred embodiments of the present invention will be more easily and better understood when read in conjunction with the FIGURES of the Drawing which include.

Figure 1:
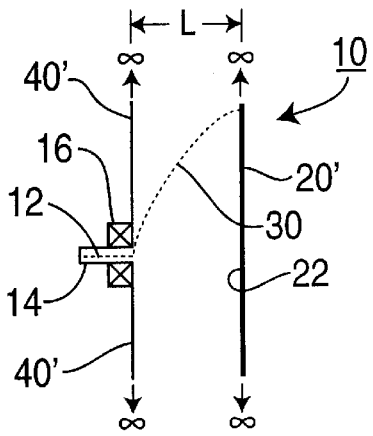
FIGS. 1 and 2 are cross-sectional schematic diagrams of an exemplary embodiment of a cathode ray tube in accordance with the present invention.

In the Drawing, where an element or feature is shown in more than one drawing figure, the same alphanumeric designation may be used to designate such element or feature in each figure, and where a closely related or modified element is shown in a figure, the same alphanumerical designation primed may be used to designate the modified element or feature. Similarly, similar elements or features may be designated by like alphanumeric designations in different figures of the Drawing and with similar nomenclature in the specification, but in the Drawing are preceded by digits unique to the embodiment described. For example, a particular element may be designated as "xx" in one figure, by "1xx" in another figure, by "2xx" in another figure, and so on.

DESCRIPTION OF THE PREFERRED EMBODIMENTS

In a cathode ray tube according to the present invention, the electrons of the electron beam(s) are further deflected after leaving the influence of the magnetic deflection yoke, i.e. in what is referred to as the "drift region" of a conventional CRT through which the electrons travel in substantially straight lines. In a conventional CRT, the electrons are at the screen or anode potential at the time they leave the gun and deflection regions and, not being under the influence of any electric or magnetic field, travel in straight lines to the screen or faceplate thereof. Such cathode ray tube may find application, for example, in television displays, computer displays, projection tubes and other applications where it is desired to provide a visual display.

FIG. 1 is a cross-sectional diagram of a cathode ray tube 10 according to the present invention in its simplest form. It is noted that unless otherwise specified, such cross-sectional diagrams may be considered to illustrate either the horizontal or the vertical deflection orientation because both appear similar in such diagrams.

In exemplary cathode ray tube 10 of FIG. 1, electrons produced by electron gun 12 located in tube neck 14 are directed towards faceplate 20 which includes a screen or anode electrode 22 which is biased at a relatively high positive potential. The electrons forming electron beam 30 produced by electron gun 12 are deflected by magnetic fields produced by deflection yoke 16 to scan across the dimension of faceplate 20. Tube 10 is illustrated in FIG. 1 in a somewhat theoretical way with two infinite parallel flat plates 20', 40' separated by a distance "L" representing the distance between flat backplate 40' and flat faceplate 20'. Backplate 40 is also biased to a relatively high positive potential, but preferably less than the potential of screen electrode 22, to which lesser potential the ultor of gun 12 is also biased for avoiding unusual electron-injection effects. Under the influence of electrostatic forces produced by the relatively high positive potential bias of backplate 40 and the magnetic field produced by deflection yoke 16, electron beam 30 is deflected over a total deflection angle. A coating of phosphorescent material 23 is disposed on faceplate 20 for producing light in response to the beam of electrons 30 impinging thereon, thereby providing a monochromatic display, or a pattern of different phosphorescent materials 23 is disposed thereon for producing different colors of light in response to the beam of electrons 30 impinging thereon through apertures in a shadow mask (not shown), thereby providing a color display.

Figure 2:
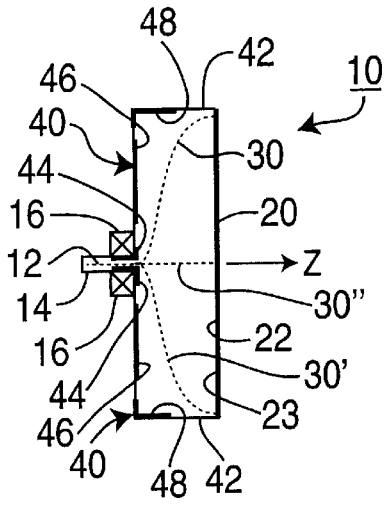

Further control of the bias potentials on the backplate of the tube to create a particular electrostatic and/or electrodyanamic field may be employed in accordance with the invention to control the trajectories of the electrons of the electron beam 30, thereby to reduce the required distance between the faceplate 20 and backplate 40 of an exemplary tube 10, as shown in FIG. 2, and to change the landing angle of the electron beam 30 therein. Tube 10 includes a gun 12 in neck 14 generally symmetrically located substantially at the center of a backplate 40 to direct a beam of electrons 30 towards faceplate 20 which includes a screen electrode 22 biased at a relatively high positive potential. Faceplate 20 and backplate 40 are of similar size and are joined by an annular end plate 42 to form a sealed container that can be evacuated. Deflection yoke 16 surrounds neck 14 in the region of its juncture with backplate 40 for magnetically deflecting electrons generated by gun 12 as they proceed out of gun 12 and toward faceplate 20 to impinge upon the phosphor(s) 23 thereon. While tube 10 is illustrated as having a substantially rectangular in cross-section in FIG. 2, the glass envelope 40–42 of a typical glass tube 10 will more closely follow the shape of the widest trajectories 30, 30' and so will resemble the shape of a conventional CRT, but be shorter in depth, and the cross-section perpendicular to the central Z axis is preferably more rectangular which tends to reduce the power required to drive magnetic deflection yoke 16.

Electrostatic fields are established within tube 10 by a number of conductive electrodes located on or close to backplate 40 and biased at respective positive potentials, i.e. at potentials of like polarity to that of the screen or anode electrode 22. A first electrode 44 surrounding the outlet of gun 12 in the vicinity of neck 14 is biased at a positive potential that is preferably less than the potential at screen electrode 22. The electrostatic field produced by electrode 44 results in the electrons of the electron beam 30 being slower moving proximate yoke 16, and therefore more easily deflected by yoke 416. The result of the cooperation between electrode 44 and yoke 16 may be utilized to realize either a reduction of yoke power, and therefore a smaller, lighter, less expensive and likely more reliable deflection yoke 416, or a greater deflection angle with the same yoke power and yoke.

A second electrode 46 also surrounding the outlet of gun 12, but spaced away from the vicinity of neck 14, is biased at a positive potential that is preferably greater than the potential at screen electrode 22. The electrostatic field produced by second electrode 46 causes the electrons of beam 30 (and of its opposite extreme 30") to travel in a parabolic path that bends their trajectories away from faceplate 20, thereby increasing the deflection angle from that produced by magnetic deflection yoke 16 alone, and also decreasing the landing angle of electron beam 30. It is desirable that electrode 46 be positioned so that the action of the electrostatic field of electrode 46 not act on the electrons of electron beam 30 until after they have been substantially fully acted upon by deflection yoke 16.

The landing angle is the angle at which the electron beam 30 impinges upon screen electrode 22, and in a color CRT, the shadow mask proximate thereto. As may be seen in FIG. 2 by comparing electron beams 30, 30' which impinge upon faceplate 20 near its periphery and electron beam 30" that impinges thereon near its center, the landing angle becomes smaller as the distance from the central or Z axis of tube 10 becomes greater and/or as the deflection angle of the electron beam 30 increases. Because the shadow mask has a finite non-zero thickness, if the landing angle is too small, e.g., less than about 25°, too many of the electrons will hit the sides of the apertures in the shadow mask instead of passing therethrough, thereby reducing the intensity of the electron beam reaching the phosphor on the faceplate 20 and of the light produced thereby.

Advantageously, electrode 48 is located distal the central or Z axis of tube 10 and near the periphery of faceplate 20 where the landing angle is smallest. A third electrode 48 also surrounding the outlet of gun 12 but substantially at the periphery of backplate 40 is biased at a positive potential that is preferably less than the potential at screen electrode 22 to direct the electrodes of beams 30 and 30" back towards faceplate 20 for increasing the landing angle of electron beams 30, 30' near the periphery of faceplate 20. Electrode 48 may be biased to a potential less than the potential at neck electrode 44 where desired to provide greater reduction of landing angle. Thus, the electrostatic fields created by electrodes 46 and 48 complement each other in that electrode 46 increases the deflection angle which decreases the landing angle at the periphery of faceplate 20, and electrode 48, which has its strongest effect near the periphery of faceplate 20, acts to increase the landing angle in the region where it might otherwise be undesirably small.

Figure 3:
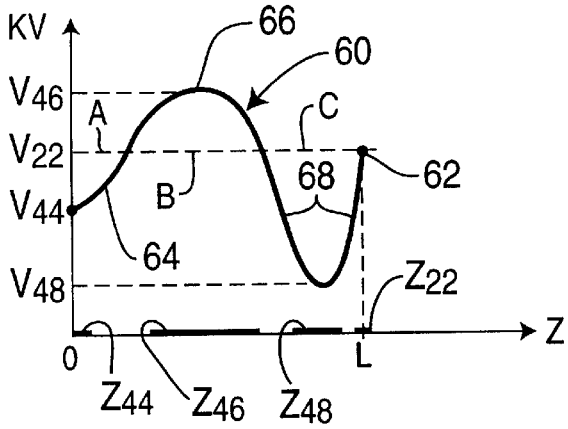
FIG. 3 is a graphical representation of the potential in the cathode ray tube of FIG. 2.

The relationship and effects of the electrostatic fields described above cooperate in a tube 10 that is shorter in depth than a conventional CRT and yet operates at a comparable and/or reasonable deflection yoke power level. An exemplary potential distribution over the depth of tube 10 along its Z axis is illustrated in FIG. 3. Potential characteristic 60 is plotted on a graph having distance from the exit of gun 12 along the ordinate and bias potential in kilovolts along the abscissa. Electrode 22 located at a distance L from gun 12 and represented by region $Z_{22}$ is biased at a relatively high positive potential $V_{22}$ represented at point 62. In order from gun 12 at Z=0 are neck electrode 44 located proximate gun 12 and represented by electrode region $Z_{44}$ that is biased at an intermediate positive potential $V_{44}$, electrode 46 located intermediate gun 12 and faceplate 20 and represented by electrode region $Z_{46}$ that is biased at a relatively high positive potential $V_{46}$ that is preferably higher than the screen potential $V_{22}$, and electrode 48 located more proximate to faceplate 20 and represented by electrode region $Z_{48}$ that is biased at an intermediate positive potential $V_{48}$ that is preferably lower than screen potential $V_{22}$ (but could be equal thereto) and could preferably be lower than gun ultor potential $V_{44}$. Electrodes 44, 46, 48, 22 and bias potentials $V_{44}$, $V_{46}$, $V_{48}$, $V_{22}$ thereon produce the potential characteristic 60 that has a portion 64 in region A rising towards the screen potential $V_{22}$ thereby tending to slow the acceleration of electrons towards faceplate 20 to provide additional flight time during which the subsequent electrostatic fields act upon the electrons. Characteristic 60 has a portion 66 in region B in which the potential peaks at a level relatively higher than the screen potential $V_{22}$ thereby to cause the electrons to move along trajectories that depart further from central axis Z of tube 10 to increase the deflection angle and a portion 68 in region C in which the potential bottoms at a level lower than the screen potential $V_{22}$ and the gun potential $V_{44}$ thereby to cause the electrons to move along trajectories that turn toward faceplate 20 of tube 10 to increase the landing angle of the electron beam near the edges of faceplate 20.

It is noted that the location of the gap between electrodes 44 and 46 can strongly affect the operation of tube 10. If electrode 46 having a relatively very high positive potential bias extends too close to the exit of gun 12 (and/or neck electrode 44 does not extend sufficiently far therefrom), then the electrons emitted from gun 12 are accelerated and additional magnetic deflection effort is required of deflection yoke 16 (e.g., additional yoke 16 power, field and/or size) to provide the desired magnetic deflection. On the other hand, if neck electrode 44 extends too far beyond the exit of gun 12, then the electrons spend too much time in region A in which electrostatic forces act counter to the deflection sought to be produced by magnetic deflection yoke 16, thereby also increasing the power, field and /or size required of yoke 16 to deflect the electron to the corners of faceplate 20, even with the beneficial effect of yoke amplifier 50. Because electrode 46 in tube 10 acts to amplify the total deflection of electron beam 30 above that produced by yoke 16, it may be referred to as a "yoke amplifier" and identified as 50.

The particular values of bias potential are selected in accordance with a particular tube 10 to obtain, for example, a suitable balance of reduced tube depth and reasonable yoke power in consideration of the effects of each of the bias potentials. For example, as the bias potential $V_{44}$ of the ultor of gun 12 is increased, the required deflection power of yoke 16 increases and the depth of tube 10 decreases, indicating that a bias potential of intermediate value is desirable. Thus, a 165° tube with $V_{22}$=30 kV and $V_{44}$=20 kV is about 13.5–15 cm (about 5.4–6 inches) shorter than a conventional 110° CRT. A constant bias potential $V_{46}$ on electrode 46 causes the electrons to follow a substantially parabolic trajectory toward faceplate 20 in region B, however, increasing the bias potential $V_{46}$ reduces the electrostatic forces pulling electrons towards faceplate 20, so that a bias potential $V_{46}$ that is near or greater than the screen potential $V_{22}$ is advantageous to cause the electrons to travel in a more nearly straight line trajectory or to curve away from faceplate 20, thereby to increase the deflection angle and reduce the depth of tube 10. Thus, a bias potential $V_{46}$ of about 30–40 kV is desirable, but, for safety, should be kept below the potential at which X-rays that could penetrate the envelope of tube 10 could be generated, i.e. below about 35 kV. Finally, bias potential $V_{48}$ is preferably a low positive potential to provide an electrostatic force that turns the electrons deflected to the edge regions of faceplate 20 more toward faceplate 20 to increase the landing angle, preferably to above 25°. This field accelerates the electrons towards faceplate 20 subsequent to their being deflected by yoke 16 and the electrostatic field forces produced by bias potential $V_{46}$ and electrode 46.

It is anticipated that the depth of tube 10 in accordance with the invention can be reduced in depth by about a factor of two as compared to a conventional 110° CRT, to provide a 100-cm (about 40-inch) diagonal 16:9 aspect ratio tube 10 having a total depth of about 35–36 cm (about 14 inches) including the neck 14. Further reduction of about 5 cm (about 2 inches) can obtain if a bent gun that does not project directly rearward from backplate 40 is employed. It is noted that shaping backplate 40 (i.e. the glass funnel of tube 10) to more closely conform to the trajectories of the furthest deflected electron beams 30, 30' improves the effectiveness of the electrostatic forces produced by electrodes 44, 46, 48, thereby to reduce the depth of tube 10. In addition, the gradual potential change over distance illustrated in FIG. 3 enables a larger diameter electron beam 30 where electron beam 30 exits gun 12, thereby reducing space charge dispersion within electron beam 30 to provide a desirably smaller beam spot size at faceplate 20. The spot size and divergence of electron beam 30 is controlled by the particular electron gun and the convergence of the desired yoke.

Figure 4:
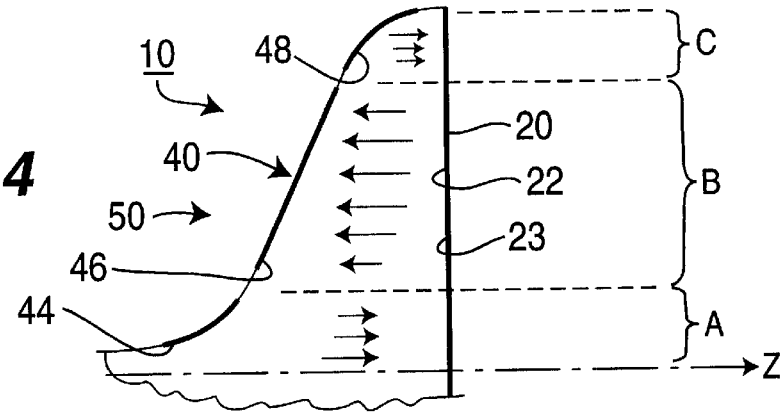
FIG. 4 is a cross-sectional diagram of the tube of FIG. 2 illustrating the electrostatic forces therein.

FIG. 4 is an exemplary embodiment of tube 10 (only half of tube 10 being illustrated because tube 10 is symmetrical about the Z axis, i.e. in what could be designated the X plane and the Y plane) of the sort mentioned above having a backplate shaped similarly to the most extremely deflected electron beams 30, 30' and having electrodes 22, 44, 46, 48 biased as described above to produce a potential distribution as in FIG. 3. In FIG. 4, however, the electron beams 30 are not illustrated, but arrows are shown directed either towards or away from faceplate 20 representing the net electrostatic force acting on the electrons of beam 30 as they pass through the regions A, B and C as described above. In region A, the net electrostatic force directs the electrons towards faceplate 20 under the influence of the relatively high positive bias potential $V_{22}$ of screen electrode 22 and the intermediate positive bias potential $V_{44}$ on neck electrode 44. In region B, the net electrostatic force deflects the electrons away from faceplate 20 under the influence of the relatively very high bias potential on backplate electrode 46 which exceeds the relatively high positive bias potential $V_{22}$ on screen electrode 22. In region C, the net electrostatic force again directs the electrons towards faceplate 20 under the influence of the screen electrode 22 relatively high positive bias potential as assisted by the low positive bias potential $V_{48}$ on electrode 48.

It is particularly noted that by virtue of the effect of the electrostatic force produced by the relatively very high bias potential on backplate electrode 46 (i.e. higher than the bias potential $V_{22}$ of screen electrode 22), electrode 46 increases the deflection of the electron beam 30 beyond that produced by the magnetic deflection of yoke 16. Thus, electrode 46 in tube 10 acts to amplify the total deflection above that produced by yoke 16, and so is referred to as a "yoke amplifier" and identified as 50. In particular, note that the deflection amplification produced by the yoke amplifier 50 is directly proportional to the deflection of any particular electron by yoke 16. In other words, electrons moving towards faceplate 20 along or near the Z axis (i.e. those undeflected or little deflected by yoke 16) are not affected by the yoke amplifier 50. Those electrons deflected by yoke 16 to land intermediate the Z axis and the edge of faceplate 20 are additionally deflected by yoke amplifier 50 because they pass through a portion of region B in which yoke amplifier 50 acts. Those electrons deflected by yoke 16 to land near the edge of faceplate 20 are additionally deflected an even greater amount by the yoke amplifier 50 because they pass through the entirety of region B in which yoke amplifier 50 acts and so are more strongly affected thereby. Yoke amplifier 50 may also be considered to include neck electrode 44 which, when biased at a potential less than the screen potential, beneficially reduces the effort or power required by deflection yoke 16 to obtain a given deflection of electron beam 30.

It is also noted that tube 10 may also be advantageous because it "looks like a conventional CRT" with a shaped glass bulb and neck, and a planar or slightly curved faceplate, and so may utilize similar manufacturing processes as are utilized for conventional CRTs. The issues of space charge effects expanding the electron beam are also similar to those in conventional CRTs and so the spot size variation with a smaller spot at the center of the faceplate and a somewhat larger spot size at the edges and corners is similar to that of the conventional CRT, although the structure and operation of tube 10 is very different therefrom. While the inventive tube 10 substantially reduced the front-to-back tube depth, the improvement is in the conical section of the glass bulb. In addition, the length of the tube neck 14 necessary to contain electron gun 12, typically less than about 23–25 cm (about 9–10 inches), can be reduced if a shorter electron gun 12 is employed.

Figure 5:
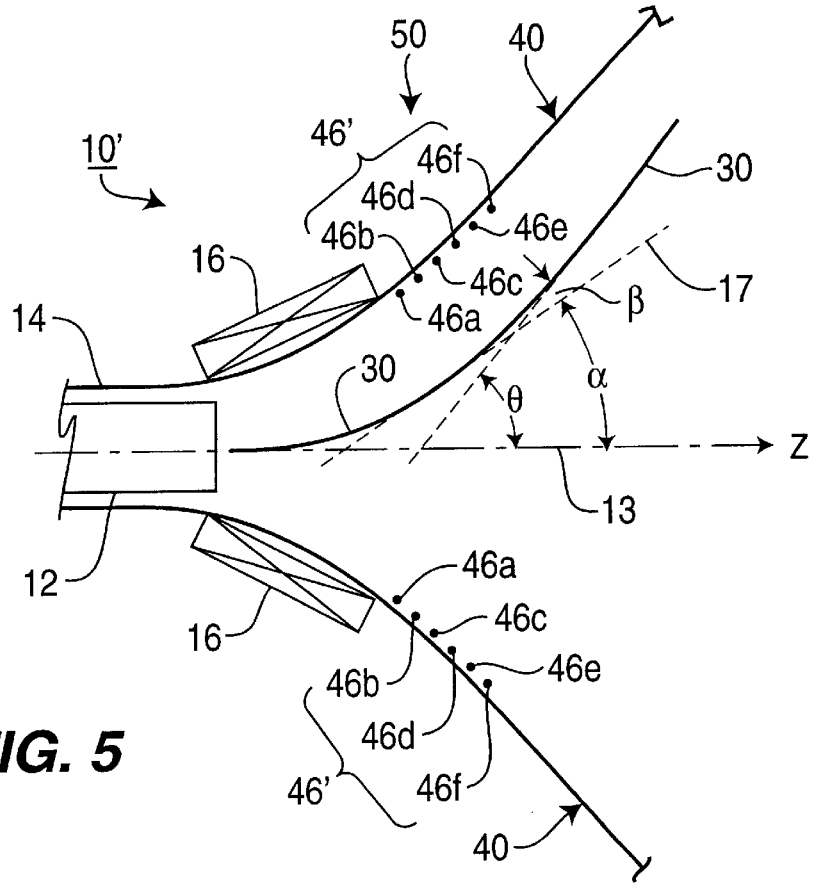
FIG. 5 is a partial cross-sectional diagram of the yoke funnel region of another exemplary tube in accordance with the invention which tube includes a modification of the tube of FIG. 2.

FIG. 5 is a partial cross-sectional diagram of an alternative embodiment of tube 10 identified as tube 10' in which electrode 46 of tube 10 is replaced by an alternative electrode 46' comprising a plurality of electrodes each having a particular value of bias potential applied thereto. Electrode 46' includes, for example, six electrodes 46*a*, 46*b*, 46*c*, 46*d*, 46*e* and 46*f* spaced apart along a section of tube backplate 40 forward of gun 12, neck 14 and magnetic deflection yoke 16. Electron beam 30 exits gun 12 directed towards faceplate 20 (not visible) and is magnetically deflected by an angle $\alpha$, a high value of which is represented by dashed line 17, typically up to an angle of ±55° with a conventional yoke 16 for a 110° tube. In addition, electron beam 30 is deflected up to an additional angle $\beta$ under the action of the yoke amplifier 50 effect produced by the electrostatic fields produced by the relatively high positive bias potentials of electrode 46' to have a total deflection angle $\Theta$ with respect to Z axis 13.

It is noted that electrode 46, whether a single electrode 46 or plural sub-electrodes 46*a*, 46*b*, . . . , may be referred to as a "yoke amplifier," a "deflection amplifier" or an "electrostatic deflection amplifier" 50 because it increases the deflection of electron beam 30 beyond the deflection produced by deflection yoke 16. In particular, the amount of increase in the deflection of electron beam 30 increases as the angle of deflection produced by yoke 16 increases. For example, electron beam 30 when directed along central axis 13 or only slightly deflected therefrom, e.g., by about 20° or less, continues to travel in a straight trajectory unaffected by electrode 46.

In tube 10' the electrodes 46*a*–46*f* are preferably biased at different relatively high positive potentials so as to more precisely shape the potential characteristic thereof (similar to characteristic 60 of FIG. 3) while not accelerating the electrons of electron beam 30 towards faceplate 22. Each of electrodes 46*a*–46*f* is preferably a ring electrode proximate tube backplate 40 and typically having a "generally rectangular shape" surrounding Z axis 13 along which is electron gun 12. Typical bias potentials for electrodes 46*a*–46*f* are, for example, 30 kV, 32 kV, 34 kV, 35 kV, 33 kV and 31 kV, respectively, with each of gun 12 and screen electrode 22 (not visible) biased to 30 kV, although the bias potential for gun 12 could be lower than that of screen electrode 22.

As used herein, "generally rectangular shape" or "substantially rectangular" refers to a shape somewhat reflective of the shape of faceplate 20 and/or the cross-section of tube envelope 40 when viewed in a direction along Z axis 13. A generally rectangular shape may include rectangles and squares having rounded corners as well as concave and/or convex sides, so as to be suggestive of dog-bone shapes, bow-tie shapes, racetrack shapes, oval shapes and the like. It is noted that by so shaping electrodes 44, 46 and/or 48, the required waveform of the drive current applied to yoke 16 may be simplified, i.e. made closer to a linear waveform. Electrodes 44, 46, 48 may be oval in shape or even almost circular, particularly where the cross-section of tube envelope 40 is of such shape, as is often the case at the rearward portions thereof, such as those proximate neck 14 and yoke 16.

Figure 6:
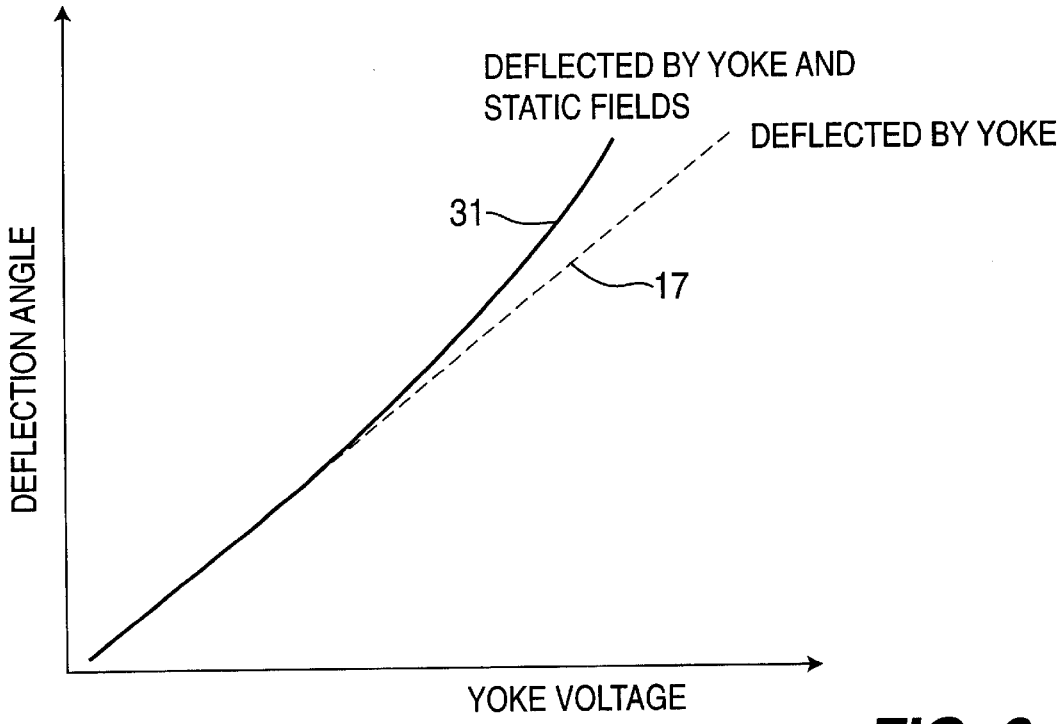
FIG. 6 is a graphical representation illustrating the performance of the cathode ray tube of FIG. 2 and/or FIG. 5.

The total deflection angle $\Theta$ obtained is the sum of the magnetic deflection angle $\alpha$ and the additional electrostatic deflection angle $\beta$. The magnetic deflection angle $\alpha$ is directly proportional to the deflection current applied to yoke 16 as illustrated by dashed line 17 of FIG. 6 and the additional electrostatic deflection angle $\beta$. is greater for greater magnetic deflections, as described above in relation to tube 10, producing line 31 representing the total deflection angle $\Theta$. The deflection amplifying effect results from the action of the electric fields produced by electrodes 46*a*–46*f* on the electrons of electron beam 30 to produce a net electrostatic force (integrated over the electron path) that pulls the electrons away from centerline 13 of tube 10', thereby increasing the total deflection angle $\Theta$. This effect is aided by the bias potential on at least some or all of electrodes 46*a*–46*f* being greater than the potential of screen electrode 22.

The structure of plural electrodes 46' may be of several alternative forms. For example, electrodes 46*a*–46*f* may be shaped metal strips printed or otherwise deposited in a pattern on the inner surface of the funnel-shaped glass backplate 40 of tube 10' and connected to a source of bias potential by conductive feedthrough connections penetrating the glass wall of funnel backplate 40. The shaped metal strips can be deposited with a series of metal sublimation filaments and a deposition mask that is molded to fit snugly against the glass wall or backplate 40. If a large number of strips 46*a*, 46*b*, . . . are employed, each of the strips 46*a*, 46*b* . . . need only be a few millimeters wide and a few microns thick, being separated by a small gap, e.g., a gap of 1–2 mm, so as to minimize charge buildup on the glass of backplate 40. A smaller number of wider strips 46*a*–46*f* of similar thickness and gap spacing could also be employed. Deposited metal strips 46*a*, 46*b*, . . . are on the surface of glass backplate 40 thereby maximizing the interior volume thereof through which electron beam 30 may be directed.

Although bias potential could be applied to each of strips 46*a*, 46*b*, . . . by a separate conductive feedthrough, having too large a number of feedthroughs could weaken the glass structure of backplate 40. Thus, it is preferred that a vacuum-compatible resistive voltage divider be employed within the vacuum cavity formed by backplate 40 and faceplate 20, and located in a position shielded from electron gun 12. Such tapped voltage divider is utilized to divide a relatively very high bias potential to provide specific bias potentials for specific metal strips 46*a*, 46*b*.

One form of suitable resistive voltage divider may be provided by high-resistivity material on the interior surface of glass tube envelope 40, such as by spraying or otherwise applying such coating material thereto. Suitable coating materials include, for example, ruthenium oxide, and preferably exhibit a resistance is in the range of $10^8$ to $10^{10}$ ohms. The high-resistivity coating is in electrical contact with the metal electrodes 44, 46, 48 for applying bias potential thereto. The thickness and/or resistivity of such coating need not be uniform, but may be varied to obtain the desired bias potential profile. Beneficially, so varying such resistive coating may be utilized for controllably shaping the profile of the bias potential over the interior surface of tube envelope 40, for example, to obtain a bias potential profile such as illustrated in FIG. 3. Thus, the complexity of the structure of electrodes 44, 46, and/or 48 may be simplified and the number of conductive feedthroughs penetrating tube envelope 40 may be reduced. In addition, such high-resistivity coating may be applied in the gaps between electrodes, such as electrodes 44, 46, 48 to prevent the build up of charge due to electrons impinging thereat.

Figure 7A:
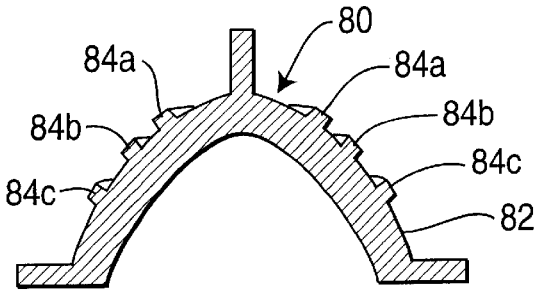
FIGS. 7A–7D are cross-sectional diagrams showing a method of forming an electrode structure in a cathode ray tube according to the invention.
Figure 7B:
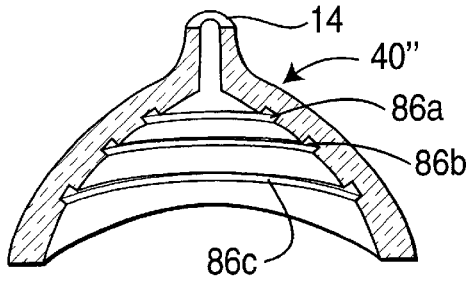
Figure 7C:
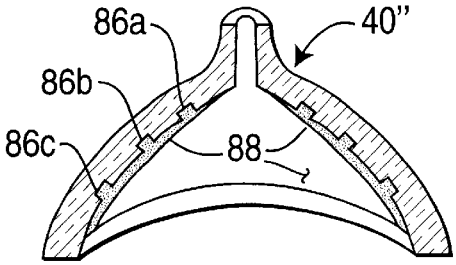
Figure 7D:
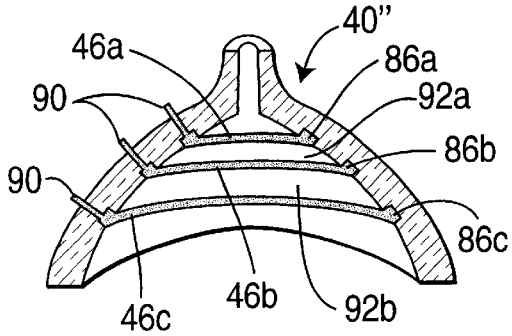

An alternative to the masked deposition of metal strips 46*a*, 46*b*, . . . described above, the process illustrated in simplified form in FIGS. 7A–7D can be utilized. A mold 80 has an outer surface 82 that defines the shape of the inner surface of the funnel-shaped glass bulb 40" of a cathode ray tube 10' and has raised patterns 84*a*, 84*b*, 84*c* thereon defining the reverse of the size and shape of the metal strips 46*a*, 46*b*, 46*c*, as shown in FIG. 7A. Upon removal from mold 80, glass bulb 40" has a pattern of grooves 86*a*, 86*b*, 86*c* in the inner surface thereof of the size and shape of the desired metal stripes 46*a*, 46*b*, 46*c*, as shown in FIG. 7B. Next, metal such as aluminum is deposited on the inner surface of glass bulb 40" sufficient to fill grooves 86*a*, 86*b*, 86*c*, as shown in FIG. 7C. Then, the metal 88 is removed, such as by polishing or other abrasive or removal method, to leave metal strips 46*a*, 46*b*, 46*c* in grooves 86*a*, 86*b*, 86*c*, respectively, of glass bulb 40", with gaps 92*a*, 92*b* therebetween, as shown in FIG. 7D. Conductive feedthroughs 90 provide external connection to metal strip electrodes 46*a*, 46*b*, 46*c* through glass bulb 40". Optionally, high resistivity material may be applied as a coating in the gaps 92*a*, 92*b*, between electrodes 46*a*, 46*b*, 46*c*.

Figure 8:
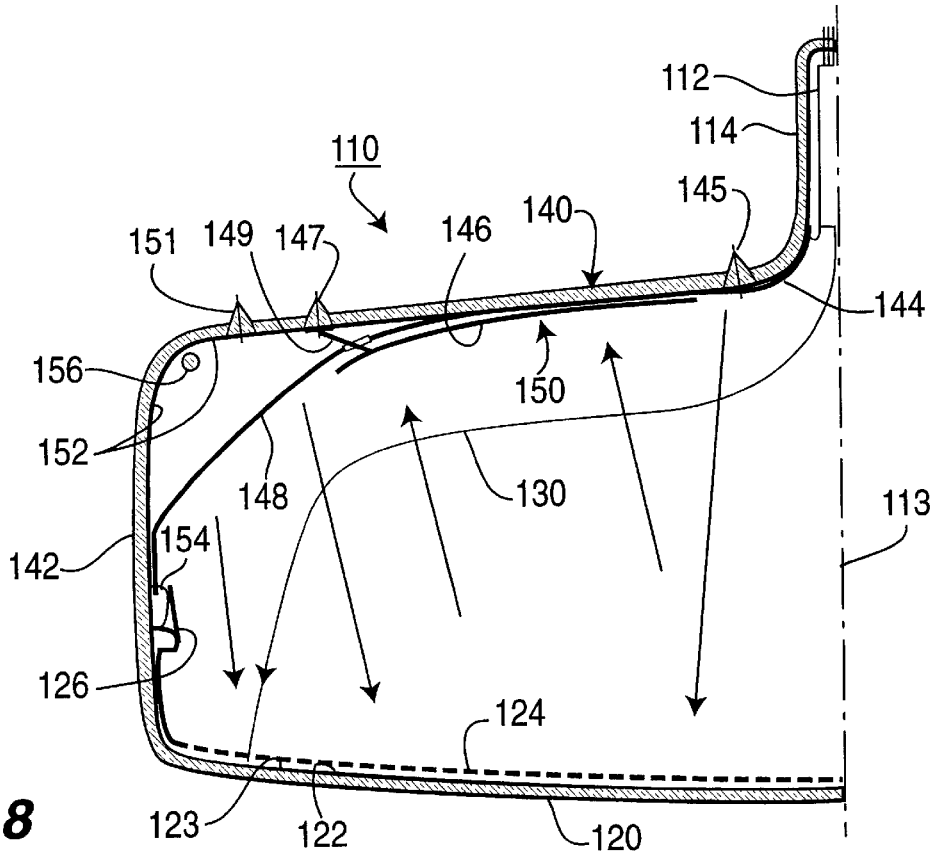
FIG. 8 is a partial cross-sectional diagram of an alternative exemplary structure providing appropriately positioned electrodes within a cathode ray tube in accordance with the invention.

Other arrangements of exemplary structures providing appropriately positioned electrodes within a cathode ray tube are described in relation to the partial cross-sectional diagrams of FIGS. 8 and 9. FIG. 8 is a partial cross-sectional diagram of one half of a cathode ray tube 110 on one side of its central axis 113 about which it is symmetrical. Cathode ray tube 110 has a funnel-shaped glass bulb 140 having a rearward projecting neck 114 in which is mounted electron gun 112 that produces electron beam 130. The forward end of glass bulb 140 is sealed to glass faceplate 120 to form a container that can be evacuated. A first or neck electrode 144 is formed of a conductive coating surrounding and proximate the juncture of neck 114, such as a deposited metal electrode pattern, that receives bias potential via conductive feedthrough 145 penetrating the wall of glass bulb 140.

Electrode 148 having a generally rectangular ring-like shape is supported at its outer periphery or edge by a plurality of glass beads 154 attached to glass sidewall 142 of glass bulb 140. Glass beads 154 also electrically insulate electrode 148 from conductive coating 152 on the inner surface of sidewall 142, which coating is at screen potential. The other end of electrode 148 is attached to the inner surface of glass bulb 140 more proximate to neck 114 so that it is in electrical contact with conductive coating 144 to receive neck bias potential therefrom. Electron gun 112 includes flexible tabs connected to its ultor electrode that also contact coating 144 to receive neck bias potential therefrom. Preferably electrode 148 is formed of a ferromagnetic material so as to also serve as a magnetic shield within tube 110 to reduce the effect of the earth's magnetic field and other unwanted fields on the deflection of electron beam 130. Because conductive coating 152 on the inner surface of glass bulb 140 lies behind electrode 148, electrode 148 electrostatically shields electron beam 130 from the electrostatic field produced by the bias potential on coating 152. Conductive coatings 144 and 152 are electrically isolated, such as by a physical gap therebetween in the region behind electrode 146, and are preferably formed of a deposited metal such as aluminum, graphite, carbon or iron oxide. Intermediate or field-shaping electrode 146 of generally rectangular ring-like shape is preferably made from stamped sheet metal, such as titanium, steel or aluminum. Electrode 146 is spaced apart from the rear wall of glass bulb 140 and is supported by a plurality of support struts 149 attached thereto. One or more of supports 149 is electrically conductive and in contact with feedthrough 147 penetrating the wall of glass bulb 140 to apply the potential on feedthrough 147 as bias potential to intermediate electrode 146. Field-shaping electrode 146 is biased to provide an electrostatic field that increases the deflection of the electrons of beam 130 further away from central axis 113 in like manner to that described above, thereby having the effect of a yoke amplifier 150. Other supports (not visible) of an insulating material support the portions of electrode 146 overlying conductive coating 144 and are located behind electrode 146 so as to be shielded thereby against charging.

Faceplate 120 has a shadow mask 124 spaced slightly apart therefrom and attached to faceplate near their respective peripheries by shadow mask mounting frame 126. Shadow mask 124 has a pattern of apertures through which electron beam 130 passes to impinge upon a pattern of color phosphors (not visible) deposited on the inner surface of faceplate 120 to produce light to reproduce an image or information on faceplate 120 that is visible to a viewer looking thereat. Conductive coating 122 on the inner surface of faceplate 120 is electrically coupled to shadow mask 124 at shadow mask mounting frame 126 and to conductive coating 152 from which conductive coating 122 and shadow mask 124 receive bias potential. Conductive coating 152, such as a deposited metal coating, receives bias potential via feedthrough 151 penetrating the glass wall of bulb 140. Shadow mask frame 126 is shaped, such as by having one or more conductive projections, to provide an electrostatic shield for each of glass beads 154 to avoid charging of beads 154. Alternatively, a separate shield for beads 154 can be employed, and can be attached to mask frame 126.

A coating of phosphorescent material 123 is disposed on faceplate 120 for producing light in response to the beam of electrons 130 impinging thereon, thereby providing a monochromatic display, or a pattern of different phosphorescent materials 123 is disposed thereon for producing different colors of light in response to the beams of electrons 130 impinging thereon through apertures in shadow mask 124, thereby providing a color display.

Desirably, field-shaping electrode 146 is positioned and shaped so that when biased as described above, in cooperation with the bias potentials applied to neck electrode 144, magnetic shielding electrode 148, shadow mask 124 and screen electrode 122, the shaped electrostatic fields produced thereby increase the deflection of electrons in electron beam 130 beyond that obtained from a magnetic deflection yoke (not visible).

In addition, an evaporable getter material 156, such as a barium getter material, may be mounted to the back surface of electrode 148 and/or the inner surface of glass bulb 140 in the space therebetween from where it is evaporated onto the back surfaces of electrodes 148 and/or 146 and/or the inner surface of glass bulb 140. The getter material 156 is positioned so as to not coat any important insulating elements, e.g., glass beads 154 or the gap isolating conductive coatings 144 and 152 or the insulating supports, if any, for electrode 146.

Figure 9B:
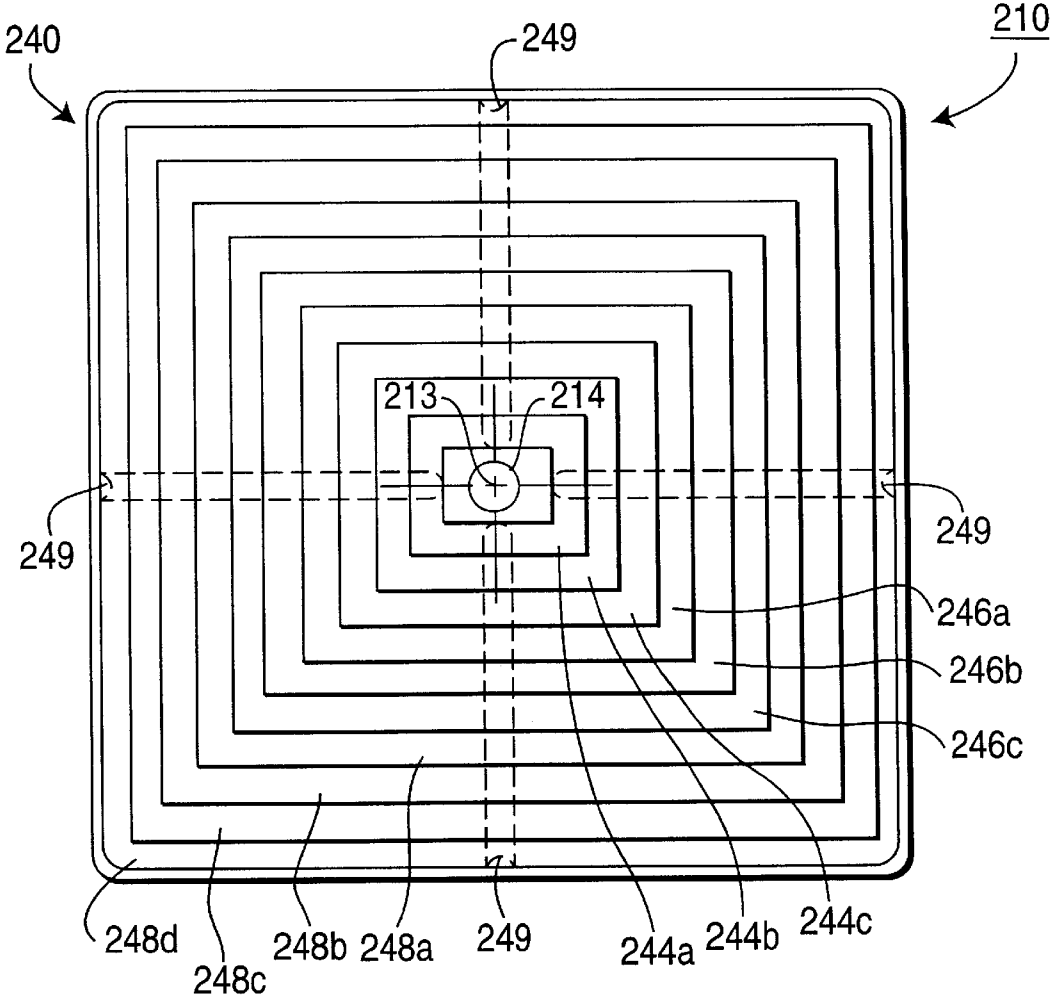
FIGS. 9A and 9B are a side cross-sectional and a front view diagrams, respectively, of an alternative exemplary structure providing appropriately positioned electrodes within a cathode ray tube in accordance with the invention.
Figure 9A:
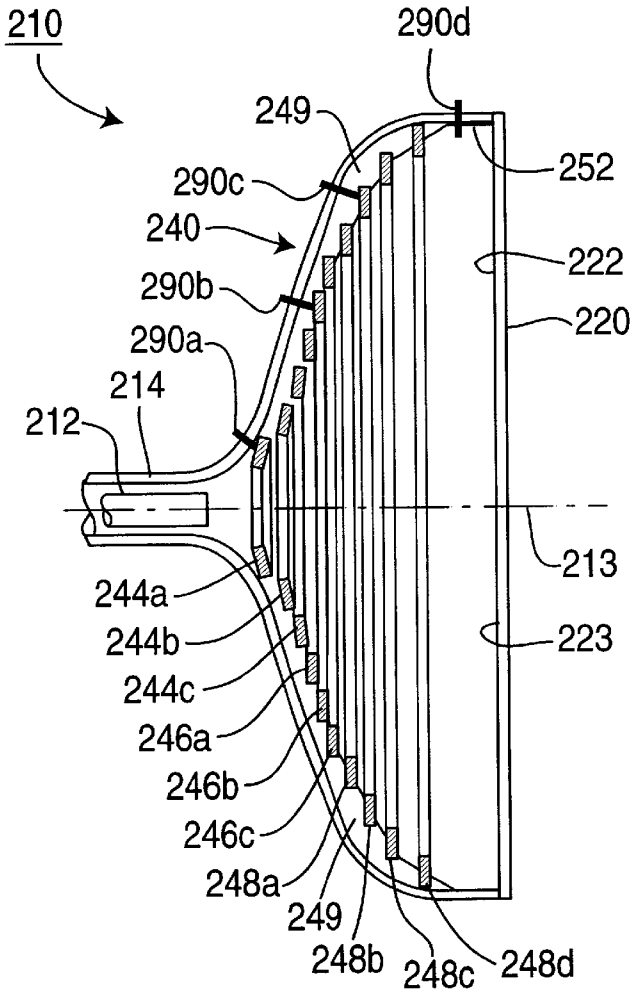

FIG. 9A is a side cross-sectional diagram of cathode ray tube 210 and FIG. 9B is a front view diagram of cathode ray tube 210 (with faceplate 220 removed) illustrating an alternative exemplary structure providing appropriately positioned electrodes 244, 246, 248 within cathode ray tube 210 in accordance with the invention. Each of the electrodes 244, 246, 248 has a generally rectangular ring-like shape of respectively larger dimension to form an array of spaced apart ring electrodes 244, 246, 248 symmetrically disposed within the interior of funnel-shaped glass bulb 240 of cathode ray tube 210. The electrodes are preferably stamped metal, such as steel, of generally rectangular shape with a generally rectangular aperture, and are mounted within glass bulb 240 by a plurality of mounts, such as elongated glass beads 249, although clips, brackets and other mounting arrangements may be employed.

Assembly is quick and economical where the rectangular metal electrodes 244, 246, 248 are substantially simultaneously secured in their respective relative positions in the four glass beads 249 with the glass beads 249 positioned, for example, at four locations such as the 12 o'clock, 3 o'clock, 6 o'clock and 9 o'clock (i.e. 0°, 90°, 180° and 270°) positions as shown, thereby to form a rigid, self-supporting structure. The assembled electrode structure is then inserted, properly positioned and secured within glass bulb 240, and faceplate 220 is then attached and sealed.

Appropriate electrical connections of predetermined ones of electrodes 244, 246, 248 are made to bias potential feedthroughs 290 penetrating the wall of glass bulb 240. Electrical connections between ones of feedthroughs 290 and predetermined ones of rectangular electrodes 244, 246, 248 are made by welding or by snubbers on the electrodes that touch the feedthrough 290 conductors. Feedthroughs 290 need be provided only for the highest and lowest bias potentials because intermediate potentials are obtained by resistive voltage dividers connected to the feedthroughs 290 and appropriate ones of rectangular electrodes 244, 246, 248. High positive potential from feedthrough **290*d* is conducted to screen electrode 222 by deposited conductor 252 and to gun 212**. For example, the following bias potential values could be utilized:

| Feedthrough Potential | Electrode | Electrode Potential | Feedthrough Potential | Electrode | Electrode Potential |
|---|---|---|---|---|---|
| | 212 (gun) | 20 kV | — | 246c | 27 kV |
| 290a = 20 kV | 244a | 20 kV | — | 248a | 24 kV |
| — | 244b | 22 kV | 290c = 18 kV | 248b | 18 kV |
| — | 244c | 26 kV | — | 248c | 22 kV |
| — | 246a | 28 kV | — | 248d | 26 kV |
| 290b = 30 kV | 246b | 30 kV | 290d = 30 kV | 222 screen | 30 kV |

Rectangular electrodes 244, 246, 248 can be made of a suitable metal to provide magnetic shielding, such as mu-metal, steel, or a nickel-steel alloy, or one or more magnetic shields could be mounted external to glass bulb 240. Electron gun 212, faceplate 220, screen electrode 224 and phosphors 223 are substantially like the corresponding elements described above.

Figure 10:
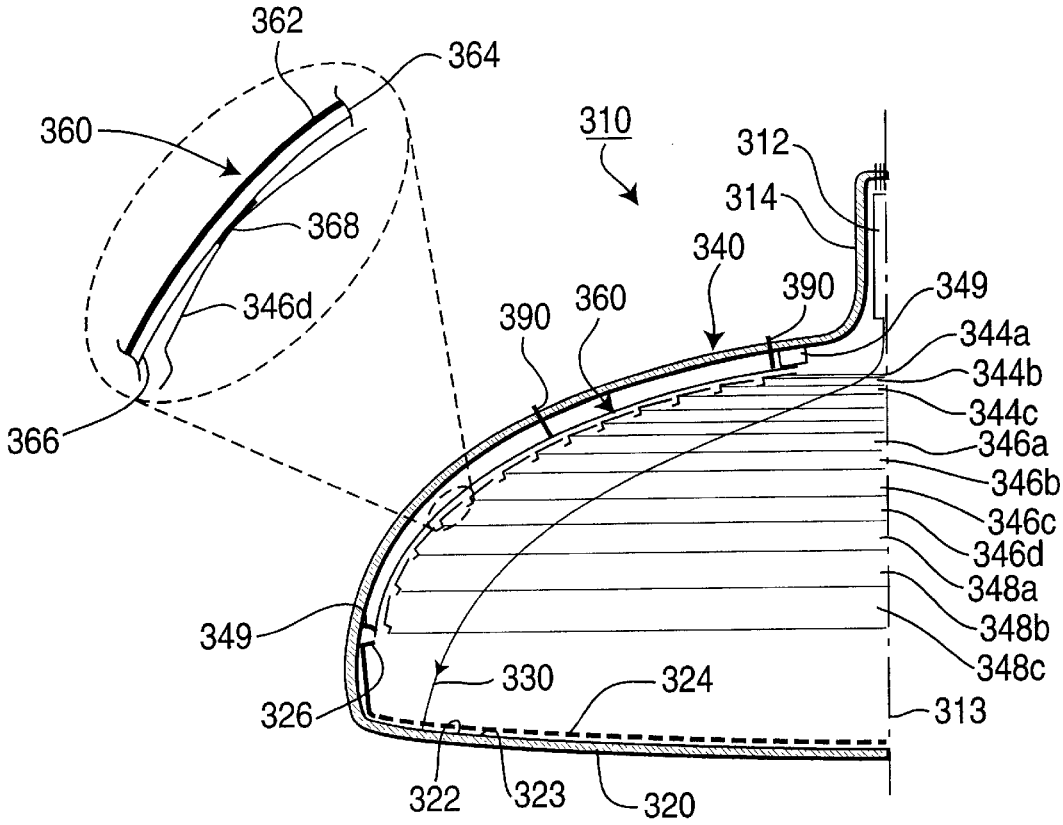
FIG. 10 is a partial cross-sectional diagram of another alternative exemplary structure providing appropriately positioned electrodes within a cathode ray tube in accordance with the invention.

FIG. 10 is a partial cross-sectional diagram of a cathode ray tube 310 showing an alternative mounting arrangement for a set of generally rectangular electrodes 344, 346, 348 having generally rectangular apertures mounted within the interior of funnel-shaped glass bulb 340 to deflect electron beam 330 as described above. Electron gun 312, neck 314, faceplate 320, phosphors 323, shadow mask 324 and frame 326, glass bulb 340 are disposed symmetrically relative to centerline 313, and may include a getter material in the space between glass bulb 340 and electrodes 344, 346, 348, all of the foregoing being substantially as described above.

Electrodes 344, 346, 348 are formed as a set of generally rectangular loops of ascending dimension and are positioned symmetrically with respect to tube central axis 313 with the smallest proximate neck 314 and the largest proximate faceplate 320. Plural support structures 360 are employed to support electrodes 344, 346, 348, such as four supports 360 disposed 90° apart, only one of which is visible in FIG. 10. Each support structure 360 is generally shaped to follow the shape of glass bulb 340 and is mounted between and attached to two insulating supports 349, such as glass beads or lips, one proximate shadow mask frame 326 and one proximate neck 314. Each of electrodes 344, 346, 348 is electrically isolated from the other ones thereof, unless it is desired that two or more of electrodes 344, 346, 348 be at the same bias potential. Electrodes 344, 346, 348 are preferably of stamped metal, such as titanium, steel or aluminum, and are preferably of a magnetic shielding metal such as mu-metal or a nickel-steel alloy to shield electron beam 330 from unwanted deflection caused by the earth's magnetic field and other unwanted fields.

Each support strip 360 is formed of a layered structure of a metal base 362, such as a titanium strip, for strength, a ceramic or other insulating material layer 364 on at least one side of the metal base 362, and spaced weldable contact pads 368 including a weldable metal, such as nickel or nichrome, to which the electrodes 344, 346, 348 are welded, as shown in the expanded inset of FIG. 10. Weldable pads 368 are electrically isolated from each other and from metal base 362 by ceramic layer 364, so that different bias potentials may be established on each of generally rectangular electrodes 344, 346, 348.

Figure 11:
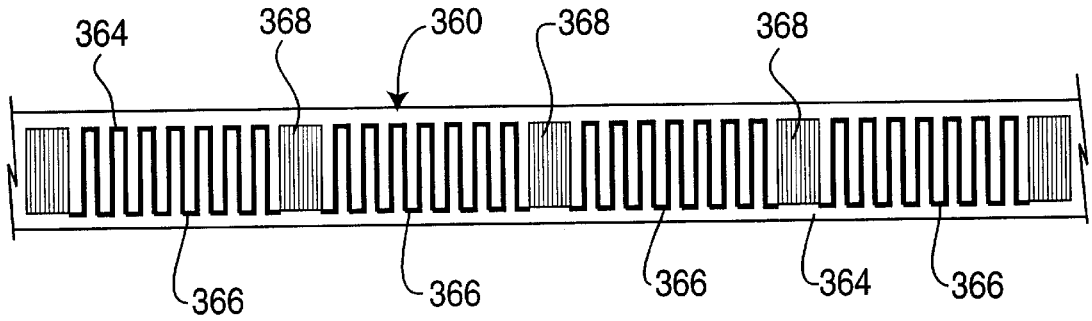
FIG. 11 is a diagram of a support useful in the tube structure shown in FIG. 10.

Preferably, one or more of support strips 360 includes a high-resistivity electrical conductor 366, such as ruthenium oxide, preferably formed in a serpentine pattern on ceramic layer 364 to provide resistors having a high resistance, e.g., on the order of $10^9$ ohms, that together form a resistive voltage divider that apportions the bias potentials applied at feedthroughs 390 to develop the desired bias potential for each one of electrodes 344, 346, 348. A ceramic layer 364 may be placed on one or both sides of metal base strip 362, and a resistive layer 366 may be formed on either or both of ceramic layers 364. A portion of one side of an exemplary support structure having serpentine high-resistance resistors 366 between weldable contact pads 368 on ceramic insulating layer 364 is illustrated in FIG. 11. Electrical connections may be made from selected appropriate ones of contact pads 368 to gun 312 and to screen electrode 322 for applying respective appropriate bias potentials thereto. Support strips 360 are preferably formed of fired laminates of the metal base and ceramic insulating and ceramic circuit layers, such as the low-temperature co-fired ceramic on metal (LTCC-M) process described in U.S. Pat. No. 5,581,876 entitled "Method of Adhering Green Tape To A Metal Substrate With A Bonding Glass."

Electrodes 344, 346, 348 and support strips 360 are assembled together into an assembly having sufficient strength to maintain its shape (owing to the strength of each component thereof) and the assembled electrodes are inserted into the interior of glass bulb 340 to the desired position, and the assembly is held in place by clips or welds (not visible) near the shadow mask frame 326 and support 349 near neck 314. The assembled structure of electrodes 344, 346, 348 and support strips 360 preferably conforms approximately to the interior shape of glass bulb 340 and is slightly spaced away therefrom. However, the structure of electrodes 344, 346, 348 and support strips 360 is positioned outside the volume through which electron beam 330 passes at any position in its scan including the extremes of deflection produced by the magnetic deflection yoke (not shown) and the amplified deflection produced by the electrostatic forces resulting from the bias potentials applied to electrodes 344, 346. Electrodes 344, 346, 348 are preferably shaped so as to shield objects behind them, such as support strips 360 and uncoated areas of the inner surface of glass bulb 340, and getter materials, from impingement of electrons from electron beam 330.

Figure 12:
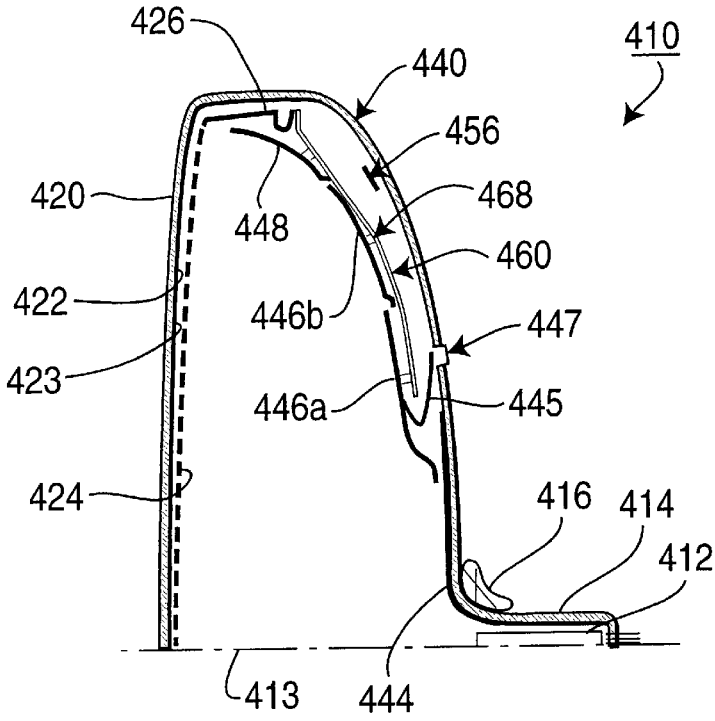
FIG. 12 is a partial cross-sectional diagram of an alternative exemplary structure providing appropriately positioned electrodes within a cathode ray tube in accordance with the invention.

FIG. 12 is a partial cross-sectional diagram of an alternative exemplary structure providing appropriately positioned electrodes 446*a*, 446*b*, 448 within a cathode ray tube 410 in accordance with the invention. Faceplate 420 and glass tube bulb 440 are joined together to form an evacuable tube envelope having a neck 414 containing electron gun 412 directing electrons towards screen electrode 422 and phosphors 423 on faceplate 420, which electrons are deflected up to ±55° from central axis 413 by magnetic deflection yoke 416. Shadow mask 424 is spaced apart from faceplate 420 supported by shadow mask frame 426 and is biased at the same potential as is screen electrode 422, e.g., 30 kV.

Neck electrode 444 sprayed or deposited on the interior surface of tube envelope 440 is biased at a potential not exceeding the screen potential, and preferably less than the screen potential, e.g., typically 10–20 kV and typically 15 kV. A plurality of electrostatic deflection electrodes 446*a*, 446*b*, 448 adapted to be biased at different potentials are spaced away from the wall of tube envelope 440 supported on support member 460 to which they are attached by respective welds 468. A high positive potential, e.g., 35 kV, is applied via feedthrough 447 and electrically-conductive support 445 to electrode 446*a* for increasing the deflection of electrons highly deflected by deflection yoke 416. Support member 460 includes a voltage divider as described above to develop different bias potentials for electrodes 446*b* and 448. Electrode 448 is typically biased to a potential less than the screen potential, e.g., 0–20 kV and typically 10 kV, while electrode 446*b* may be biased to either the potential of electrode 446*a* or that of electrode 448, e.g., 35 kV and 10 kV, respectively. A getter material 456 is positioned at convenient locations behind electrodes 446*a*, 446*b*, 448 and support 460. Preferably electrode 448 is biased at a low positive voltage with respect to screen electrode so as to decrease the landing angle of electrons coming under the influence of the electric field produced by the bias potential thereon.

Figure 13:
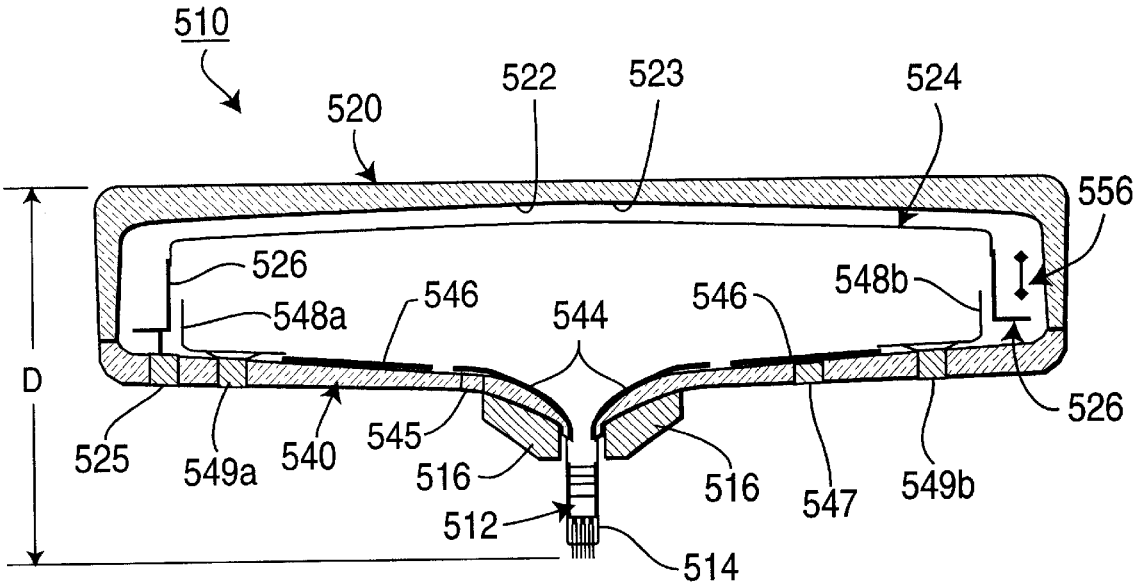
FIG. 13 is a cross-sectional diagram of a further alternative exemplary structure providing appropriately positioned electrodes within a cathode ray tube in accordance with the invention.

FIG. 13 is a cross-sectional diagram of a further alternative exemplary structure providing appropriately positioned electrodes 544, 546, 548 within a display tube 510 in accordance with the invention. In particular, tube 510 is an exemplary 757-mm (about 32-inch) diagonal 16:9 aspect format cathode ray tube having a viewable area of 660 mm (about 26 inch) width and 371 mm (about 14.6 inches) height. As a result of the reduction in tube depth attainable with the present invention, tube 510 has a depth D of about 280 mm (about 11 inches).

As before, tube 510 includes a tube envelope formed by joining faceplate 520 and tube envelope 540. Electron gun 512 in tube neck 514 directs a beam of electrons toward faceplate 520, screen electrode and phosphors 523, through apertures in shadow mask 524, subject to deflection over ±55° responsive to yoke 516. Yoke 516 may be a 110° or a 125° saddle-saddle type yoke including of a horizontal coil, a vertical coil, a ferrite core and a pair of permeable metal shunts for shaping vertical deflection for self convergence. With the larger deflection-angle 125° yoke, the diameter of tube neck 514 may be reduced, thereby to allow a smaller yoke 516 that requires a lower drive power.

Cathode ray tube 510 employs a combination of electrodes including conductive coatings on tube enclosure 540 and metal electrodes supported within tube envelope 540. Neck electrode 544 surrounding the outlet of electron gun 512 and tube neck 514 is formed of a conductive coating on the wall of tube envelope 540 and is biased at a bias potential that does not exceed the screen bias potential and is applied via feedthrough 545 penetrating the wall of tube envelope 540. The low bias potential of neck electrode 544, e.g., 10–20 kV and typically about 15 kV, tends to slow the electrons down thereby increasing the effectiveness of magnetic deflection yoke 516. Deflection enhancing electrode 546 surrounds neck electrode 544, is formed of a conductive coating and is biased at a bias potential that exceeds the screen potential and is applied via feedthrough 547 penetrating the wall of tube envelope 540. Thus, the bias potential applied to deflection enhancing electrode 546, e.g., 35 kV, produces an electric field that acts on the electrons of the electron beam after substantially all of the deflection thereof by yoke 516 is accomplished to increase the deflection of the electron beam from electron gun 512 beyond that provided by deflection yoke 516.

Third electrode 548 is formed of a piece of metal having an "L"-shaped cross-section and is biased at a potential that is applied via feedthroughs 549 penetrating the wall of tube envelope 540. Electrode 548 is biased at a potential that is less than the screen potential and preferably less than the neck electrode 544 potential, e.g., 0–20 kV and typically about 10 kV, thereby to produce an electric field that directs the electrons reaching the peripheral regions of faceplate 520 towards faceplate 520, thereby to decrease the landing angle thereof. Because tube 510 is much shorter in the vertical dimension than in the horizontal dimension (illustrated in FIG. 13), electrode 548 need not be rectangular as described above so as to act on electrons directed toward the top and bottom edges of the viewable area of faceplate 520, but may be two straight L-shaped metal electrodes 548*a*, 548*b* receiving bias potential via feedthroughs 549*a*, 549*b*, respectively, to act only on those electrons directed towards the left and right vertical edges of tube 510. Electrodes 548*a*, 548*b* are attached to feedthroughs 549*a*, 549*b*, respectively for physical support, such as by a weld or a glass to metal attachment, e.g., a conductive glass frit material.

Shadow mask 524 is supported by shadow mask frame 526 and receives screen electrode 522 bias potential via feedthrough 525 penetrating the wall of tube envelope 540. Screen potential is, e.g., 30 kV. Getter material 556 is placed at convenient locations, such as behind shadow mask frame 526 and electrode 548*a*, 548*b*.

In any of the foregoing embodiments, where a conductive coating or electrode is on the surface of the tube envelope, such as a faceplate 20, 120, 220, 320, 420 and so forth, such coating or electrode is preferably a sprayed, sublimated, spin coated or other deposition or application of graphite or carbon-based materials, aluminum or aluminum oxide or other suitable conductive material. Where electrodes, such as electrodes 46*a*–46*f*, 146, 148, 244*a*–244*c*, 246*a*–246*c*, 248*a*–248*d*, 344*a* . . . 348*c*, and so forth, are spaced away from the wall of tube envelope 40, 140, 240, 340, 440 and so forth, such electrodes are preferably formed of a suitable metal such as a titanium, Invar alloy, steel, stainless steel, or other suitable metal.

While the present invention has been described in terms of the foregoing exemplary embodiments, variations within the scope and spirit of the present invention as defined by the claims following will be apparent to those skilled in the art. For example, the present cathode ray tube can be a monochrome tube having a phosphor coating on the inner surface of the faceplate thereof or may be a color tube having a pattern of color phosphors thereon and a shadow mask having a pattern of apertures corresponding to the pattern of color phosphors, whether described herein as having or not having a shadow mask. Where a higher efficiency shadow mask is available, such as a shadow mask that enables a larger proportion of the electrons of electron beam to pass through the apertures thereof, such high-efficiency shadow mask could be employed in cathode ray tubes of the present invention, thereby resulting in one or more of increased brightness, reduced spot size or reduced gun diameter (and the benefit of increased deflection angle or reduced yoke power associated therewith).

Bias potentials developed by voltage dividers may be developed by resistive voltage dividers formed of discrete resistors, blocks of high-resistivity material, coatings of high-resistivity material and other suitable voltage dividers. While the bias potential applied to the peripheral electrode 48, 148, 248 is preferably less than the screen potential, it may be equal thereto, may be less than the bias potential of neck electrode 44, 144, 244, and may even be at zero or ground potential or negative.

What is claimed is:

1. A tube comprising:

a tube envelope including a tube funnel and a faceplate, and having a screen electrode on the faceplate biased at a screen potential;

a shadow mask proximate said faceplate having a plurality of apertures therethrough and biased at the screen potential;

a source of a beam of electrons directed toward said faceplate, wherein said source is disposed for magnetic deflection of said beam of electrons;

a pattern of phosphorescent material disposed on said faceplate for producing light of different colors in response to the beam of electrons impinging thereon through the apertures of said shadow mask;

mounting means for mounting a plurality of metal electrodes thereon interior said tube envelope between said source and said shadow mask, each metal electrode defining a respective aperture through which the beam of electrons passes, wherein said mounting means and said plurality of metal electrodes thereon mount to said tube funnel;

said plurality of electrodes including at least a first metal electrode intermediate said source and said shadow mask and biased at a potential not less than the screen potential, and a second metal electrode between said first metal electrode and said shadow mask and biased at a potential less than the screen potential.

2. The tube of claim 1 wherein the apertures of said first and second metal electrodes have a shape substantially the same as that of said faceplate.

3. The tube of claim 1 wherein the apertures of said first and second metal electrodes are substantially rectangular.

4. The tube of claim 1 further comprising a third electrode defining an aperture through which the beam of electrons passes, wherein said third electrode is between said source and said first metal electrode and is biased at a potential not exceeding the screen potential.

5. The tube of claim 4 wherein said second metal electrode is biased at a potential less than the potential at which said third electrode is biased.

6. The tube of claim 4 wherein the aperture of said third electrode is substantially rectangular.

7. The tube of claim 4 wherein said third electrode includes a conductive material on an interior surface of said tube envelope.

8. The tube of claim 1 wherein at least one of said first and second metal electrodes includes a plurality of sub-electrodes biased at different potentials.

9. The tube of claim 8 wherein said plurality of sub-electrodes are mounted to said mounting means.

10. The tube of claim 1 wherein said mounting means includes a plurality of supports to which said plurality of metal electrodes are attached.

11. The tube of claim 10 wherein said plurality of supports are attached to the interior of said tube envelope and at least one of said plurality of metal electrodes is electrically connected to a conductor penetrating said tube envelope.

12. The tube of claim 1 further comprising a voltage divider within said tube envelope and adapted for receiving a bias potential for developing at least one of the potentials at which said first and second metal electrodes and said screen electrode are biased.

13. The tube of claim 12 wherein said voltage divider includes a resistive voltage divider formed of one of a plurality of resistors and a high-resistivity coating.

14. A display comprising:

a tube envelope including a tube funnel and a faceplate, and having a screen electrode on the faceplate biased at a screen potential;

a source within said tube envelope of a beam of electrons directed toward said faceplate;

a deflection yoke proximate said source of a beam of electrons and said tube funnel for magnetically deflecting said beam of electrons;

a pattern of phosphorescent material disposed on said faceplate for producing light in different colors in response to the beam of electrons impinging thereon;

a shadow mask proximate said faceplate having a plurality of apertures therethrough and biased at the screen potential;

mounting means for mounting a plurality of metal electrodes thereon for mounting interior said tube funnel between said source and said shadow mask, each metal electrode defining a respective aperture through wlich the deflected beam of electrons passes;

said plurality of metal electrodes interior said tube envelope including a first metal electrode intermediate said source and said shadow mask and biased at a first potential not less than the screen potential, and a second metal electrode between said first metal electrode and said shadow mask and biased at a second potential less than the screen potential; and a source of potential providing the first, second and screen potentials.

15. The display of claim 14 wherein the apertures of said first and second metal electrodes have a shape substantially the same as that of said faceplate.

16. The display of claim 14 wherein the apertures of said first and second metal electrodes are substantially rectangular.

17. The display of claim 14 further comprising a third electrode defining an aperture through which the beam of electrons passes, wherein said third electrode is between said source of a beam of electrons and said first metal electrode and is biased at a third potential not exceeding the screen potential.

18. The display of claim 17 wherein said second metal electrode is biased at a potential less than the potential at which said third electrode is biased.

19. The display of claim 17 wherein the aperture of said third electrode is substantially rectangular.

20. The display of claim 17 wherein at least one of said first and second electrodes and said third electrode includes a conductive material on an interior surface of said tube envelope.

21. The display of claim 14 wherein at least one of said first and second metal electrodes includes a plurality of sub-electrodes biased at different potentials.

22. The display of claim 21 wherein said plurality of sub-electrodes are mounted to said mounting means.

23. The display of claim 14 wherein said mounting means includes a plurality of supports to which said plurality of metal electrodes are attached.

24. The display of claim 23 wherein said plurality of supports are attached to said tube envelope and at least one of said plurality of metal electrodes is electrically connected to a conductor penetrating said tube envelope.

25. The display of claim 14 wherein said source of potential comprises a voltage divider within said tube envelope receiving a bias potential for developing at least one of the first, second and screen potentials.

26. The display of claim 25 wherein said voltage divider includes a resistive voltage divider formed of one of a plurality of resistors and a high-resistivity coating.

27. A cathode ray tube comprising:

a tube envelope having a generally flat rectangular faceplate and a screen electrode on the faceplate biased at a screen potential, and having a tube funnel joining a tube neck to said faceplate;

in said tube neck, a source of a beam of electrons directed toward said faceplate, wherein said source is disposed for magnetic deflection of the beam of electrons;

a deflection yoke around said tube funnel for deflecting the beam of electrons from said source over a predetermined range of deflection angles, whereby the deflected beam of electrons impinges upon a given area of the screen electrode;

a shadow mask proximate said faceplate having a plurality of apertures therethrough, wherein said shadow mask is biased at the screen potential;

phosphorescent material disposed on said faceplate, wherein said phosphorescent material includes a pattern of different phosphorescent materials that emit different respective colors of light in response to the beam of electrons impinging thereon through the apertures of said shadow mask;

at least first, second and third deflection electrodes each defining a respective aperture interior said tube funnel through which the beam of electrons passes, wherein said first deflection electrode is proximate said source and is biased at a potential not exceeding the screen potential, wherein said third deflection electrode is proximate said shadow mask and is biased at a potential less than the screen potential, wherein said second deflection electrode is between said first deflection electrode and said third deflection electrode and is biased at a potential greater than the screen potential, and wherein ones of said first, second and third deflection electrodes are generally rectangular metal electrodes; and mounting means for mounting the generally rectangular metal ones of said first, second and third deflection electrodes prior to and after the insertion thereof into said tube funnel, whereby the deflected beam of electrons further deflected by at least said second deflection electrode impinge on an area of said screen electrode that is larger than the given area thereof.

28. The cathode ray tube of claim 27 wherein said mounting means includes a plurality of supports to which said generally rectangular metal ones of said first, second and third electrodes are attached, wherein said plurality of supports are disposed proximate said tube funnel in a direction extending between said tube neck and said faceplate.

29. A cathode ray tube comprising:

a tube envelope having a generally flat rectangular faceplate and a screen electrode on the faceplate biased at a screen potential, and having a tube funnel joining a tube neck to said faceplate;

in said tube neck, a source of plural beams of electrons directed toward said faceplate, wherein said source is disposed for magnetic deflection of the plural beams of electrons;

a deflection yoke around said tube funnel for deflecting the plural beams of electrons from said source over a predetermined range of deflection angles, whereby the deflected plural beams of electrons impinges upon a given area of the screen electrode;

a shadow mask proximate said faceplate having a plurality of apertures therethrough, wherein said shadow mask is biased at the screen potential;

phosphorescent material disposed on said faceplate, wherein said phosphorescent material includes a pattern of different phosphorescent materials that emit different respective colors of light in response to the plural beams of electrons impinging thereon through the apertures of said shadow mask;

at least first, second and third deflection electrodes each defining a respective aperture interior said tube funnel through which the plural beams of electrons passes, wherein said first deflection electrode is proximate said source and is biased at a potential not exceeding the screen potential, wherein said third deflection electrode is proximate said shadow mask and is biased at a potential less than the screen potential, wherein said second deflection electrode is between said first deflection electrode and said third deflection electrode and is biased at a potential greater than the screen potential, and wherein ones of said first, second and third deflection electrodes are generally rectangular metal electrodes;

means for mounting the generally rectangular metal ones of said first, second and third deflection electrodes prior to insertion thereof into said tube funnel; and means for securing the mounting means and generally rectangular metal ones of said first, second and third deflection electrodes mounted thereto after the insertion thereof into said tube funnel, whereby the deflected plural beams of electrons further deflected by at least said second deflection electrode impinge on an area of said screen electrode that is larger than the given area thereof.

30. The cathode ray tube of claim 29 wherein said mounting means includes a plurality of supports to which said generally rectangular metal ones of said first, second and third electrodes are attached, wherein said plurality of supports are disposed proximate said tube funnel in a direction extending between said tube neck and said faceplate.

* * * * *